US005207586A

United States Patent [19]

MacGregor et al.

[11] Patent Number: 5,207,586

[45] Date of Patent: May 4, 1993

[54] INTEGRAL CONNECTOR SYSTEM FOR CREDIT CARD SIZE I/O CARD EXTERNAL CONNECTOR

[75] Inventors: Duncan D. MacGregor, Shingle Springs; Carl Perkins, Irvine, both of Calif.

[73] Assignee: Intel Corporation, Santa Clara, Calif.

[21] Appl. No.: 941,766

[22] Filed: Sep. 4, 1992

Related U.S. Application Data

[63] Continuation of Ser. No. 782,210, Oct. 24, 1991, abandoned.

[51] Int. Cl.[5] ..... H01R 13/00

[52] U.S. Cl. ..... 439/76

[58] Field of Search ..... 439/55, 76

[56] References Cited

U.S. PATENT DOCUMENTS

| | | | |
|---|---|---|---|
| 3,200,361 | 8/1965 | Schwartz et al. . | |
| 3,479,633 | 11/1969 | Winston et al. | 439/76 |
| 3,541,396 | 11/1970 | Cardwell et al. | 439/76 |
| 4,384,368 | 5/1983 | Rosenfeldt et al. . | |
| 4,388,671 | 6/1983 | Hall et al. . | |
| 4,399,487 | 8/1983 | Neumann . | |
| 4,491,981 | 1/1985 | Weller et al. . | |
| 4,531,176 | 7/1985 | Beecher, II . | |
| 4,767,338 | 8/1988 | Denis et al. | 439/76 |
| 4,780,570 | 10/1988 | Chuck . | |
| 4,780,791 | 10/1988 | Morita et al. . | |
| 4,821,146 | 4/1989 | Behrens et al. . | |
| 4,849,944 | 7/1989 | Matsushita . | |
| 4,872,091 | 10/1989 | Maniwa et al. . | |
| 4,889,495 | 12/1989 | Kimura . | |
| 4,955,817 | 9/1990 | Sugai . | |
| 4,980,856 | 12/1990 | Ueno . | |
| 5,050,041 | 9/1991 | Shafi . | |

OTHER PUBLICATIONS

"PC Card Standard-Release 1.0", Aug. 1990, ITT Cannon Specification, pp. 1-26.

*Primary Examiner*—Joseph H. McGlynn

*Attorney, Agent, or Firm*—Blakely, Sokoloff, Taylor & Zafman

[57] ABSTRACT

A connector that can be attached to a printed circuit board. The connector has a plastic connector housing which includes a contact body and a frame. The contact body contains a plurality of electrically conductive pins that can be mated with the sockets of an external connector. The frame is integral with the contact body and extends around the edges of the printed circuit board. The frame has a ridge that allows the printed circuit board to be mounted directly to the connector.

5 Claims, 2 Drawing Sheets

INTEGRAL CONNECTOR SYSTEM FOR CREDIT CARD SIZE I/O CARD EXTERNAL CONNECTOR

This is a continuation of application Ser. No. 07/782,210 filed Oct. 24, 1991, now abandoned.

BACKGROUND OF THE INVENTION

1. Field of the Invention

The present invention relates to electronic packaging for cards and electrical connectors.

2. Description of Related Art

Computers are usually constructed with a plurality of electronic cards that are coupled to a motherboard. The cards have a connector at one end that plug into mating connectors mounted on a motherboard. The cards will typically have another connector on the opposite end to allow the computer to be coupled to an external device. Such a connector is commonly found on internal modem or facsimile cards.

High density connectors are commonly of the pin/-socket type. Pin/socket connectors have electrically conductive pins and mating sockets that are embedded in separate dielectric housings. Most pin/socket connectors have a metal shell around the dielectric housings. The shell provides structural support for the connector and protects the dielectric and electrical contacts from being damaged. The shell may have a pair of tabs or ears that allow the connector to be bolted onto the card. Connector attachment is somewhat time consuming, typically requiring the installation of fasteners. It would therefore be desirable to have a connector that can be attached to an electronic card without fasteners.

It has always been desirable to add additional cards to a computer system. In most personal computers, a cover must be removed to add or replace the cards. With laptop computers removing the cover or disassembling the housing is impractical. It is desirable to have a computer that allows a card to be plugged into the system through a slot in the housing. Because laptop computers are relatively thin, the slots are somewhat narrow. It has been found that standard pin/socket connectors are two wide to allow the cards to be inserted into the narrow slots. It would therefore be desirable to provide a thin connector that can allow a card to be inserted into a portable computer system such as a laptop.

SUMMARY OF INVENTION

The present invention is a connector that can be attached to a printed circuit board. The connector has a plastic connector housing which includes a contact body and a frame. The contact body contains a plurality of electrically conductive pins that can be mated with the sockets of an external connector. The frame is integral with the contact body and extends around the edges of the printed circuit board. The frame has a ridge that allows the printed circuit board to be mounted directly to the connector. There is no requirement for screws or other fasteners to attach the connector. The frame provides structural support for the contact body, so that there is no need for a metal shell, thereby reducing the width of the connector. The present connector can therefore be used on electronic cards with a small profile, such that the cards can be inserted through a narrow slot of a computer housing.

Therefore it is object of this invention to provide an electronic card that can be inserted into a portable computer.

It is also an object of this invention to provide a connector with a narrow profile.

It is also an object of this invention to provide a plastic connector that has the structural integrity of a connector with a metal shell.

BRIEF DESCRIPTION OF THE DRAWINGS

The objects and advantages of the present invention will become more readily apparent to those skilled in the art after reviewing the following detailed description and accompanying drawings, wherein.

DETAILED DESCRIPTION OF THE INVENTION

Figure 1:
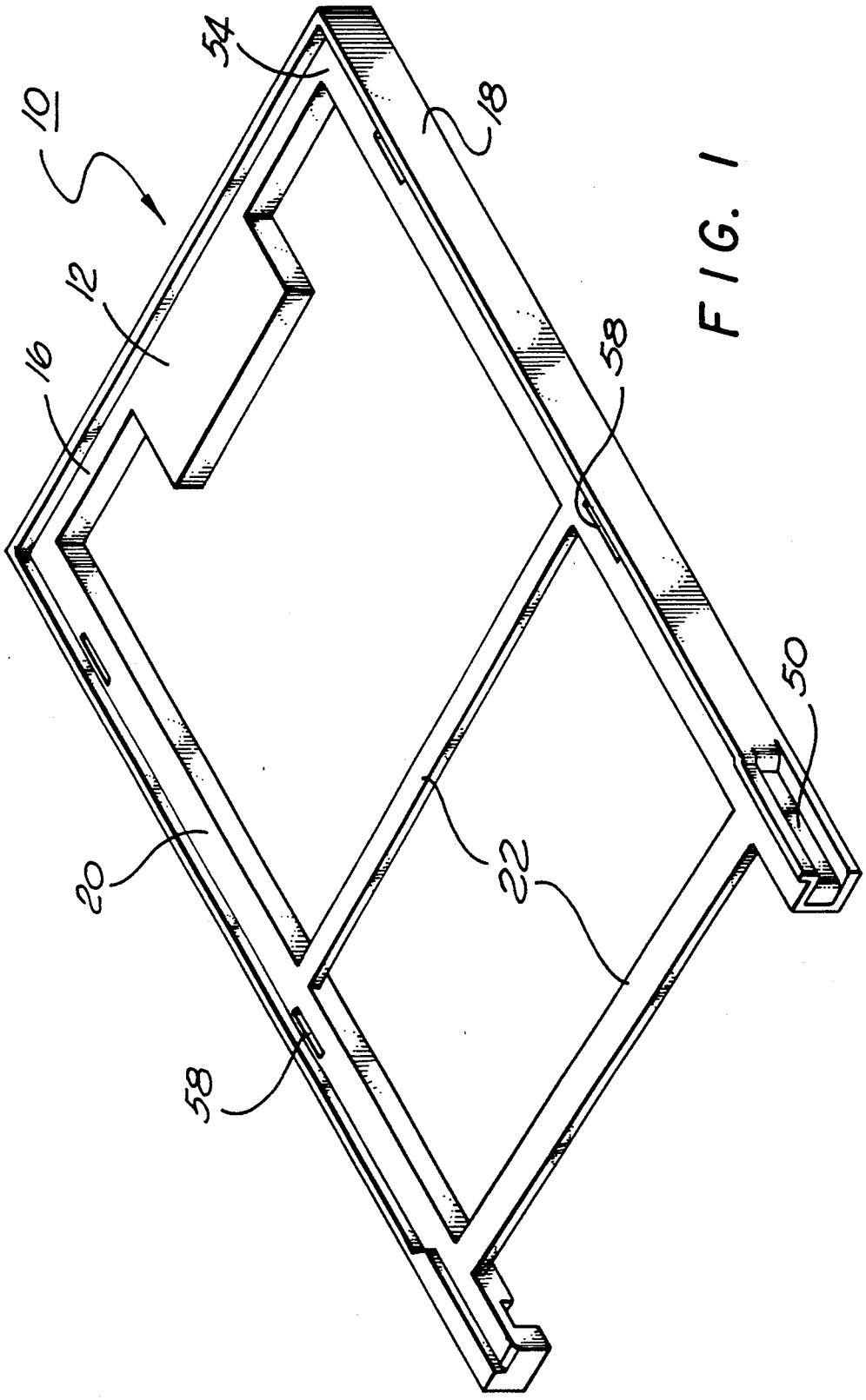
FIG. 1 is a perspective view of a connector of the present invention.
Figures 2, 3:
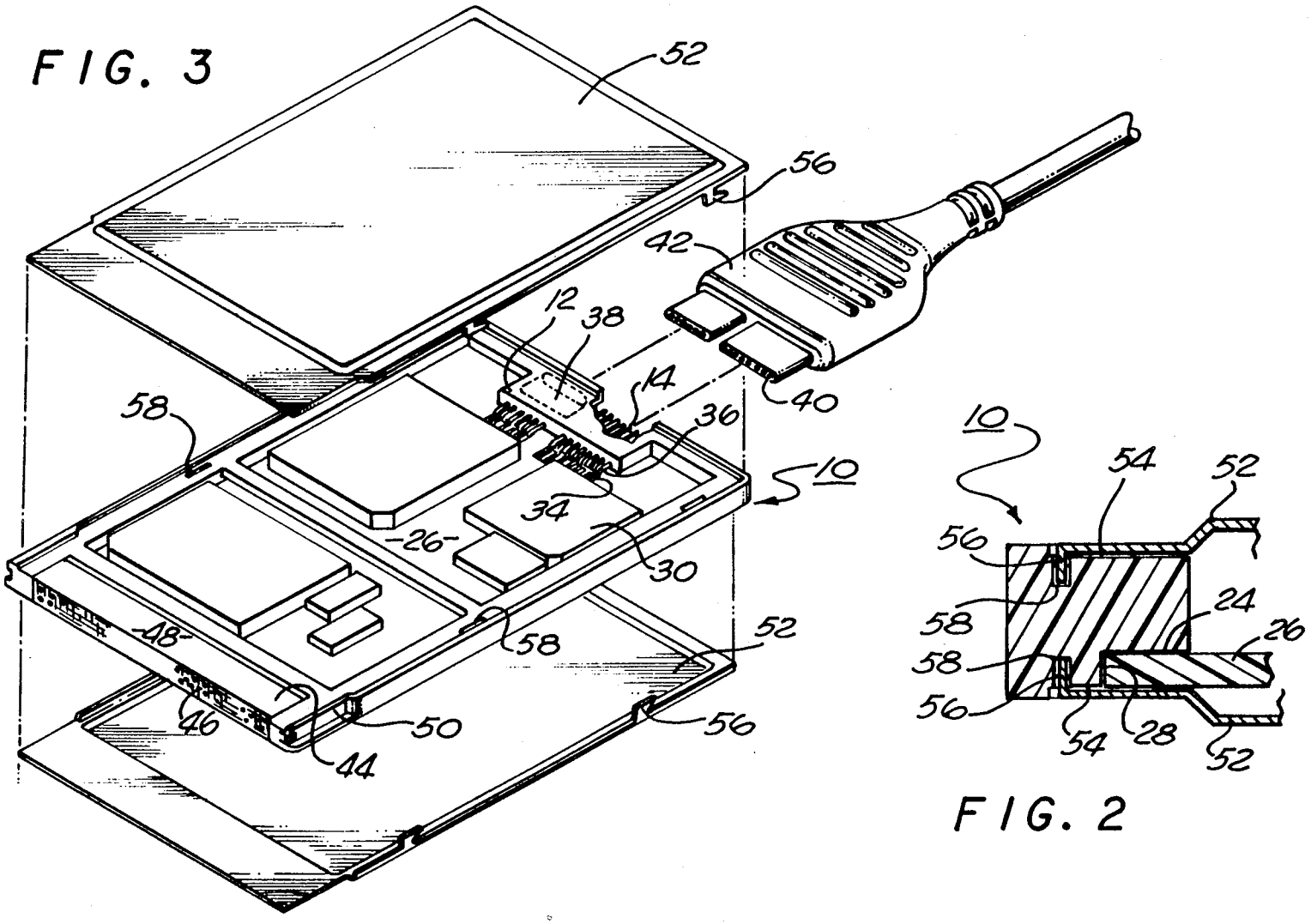
FIG. 2 is a cross-sectional view of the connector of FIG. 1.
FIG. 3 is a perspective view of the connector mounted onto a printed circuit board.

Referring to the drawings more particularly by reference numbers, FIGS. 1 and 3 show a connector 10 of the present invention. The connector 10 has a contact body 12 that houses a plurality of electrical contacts 14. Extending from the body 12 is a first end section 16. Extending from the first end section 16 are first 18 and second 20 edge sections. The end and edge sections are integrally formed with the contact body 12. The connector 10 is typically constructed from a dielectric material such as polycarbonate, or other plastic material that is injection molded into the shape shown. The plastic may be metal plated to provide a protective surface. The connector 10 may have a pair of support beams 22 that provide structural support for the edge sections 18 and 20.

FIG. 2 shows a cross-section of the connector 10. The connector 10 has a first ridge 24 that extends around the entire length of the connector 10. The first ridge 24 provides an area for a printed circuit board 26 to be mounted onto the connector 10. The circuit board 26 typically has a width less than the distance between the ridge walls 28 of the edge sections, such that the board 26 can be merely placed onto the connector 10. The board 26 may be bonded onto the first ridge 24 with an epoxy or other adhesive to firmly attach the two pieces together.

The printed circuit board 26 usually has a number of electronic device 30 attached thereto. The circuit board 26 has a plurality of conductive leads that terminate at either pads 34, or plated through holes, on the ends of the board 26. The electrical contacts 14 typically have tails 36 that are soldered onto the pads or into the holes, after the connector 10 is mounted onto the circuit board 26. The conductive leads couple the contacts 14 to the electronic devices 30.

The contacts 14 are typically gold plated copper pins located within a pair of slots 38 formed within the contact body 12. The pins 14 can be inserted into sockets 40 embedded within a mating external connector 42. The slots 38 are adapted to allow the external connector 42 to be inserted into the contact body 12, to engage the pins 14 and sockets 40. The connectors can be keyed by making one slot larger than the other slot, so that the pins 14 are always coupled to the correct sockets 40. The contact body 14 is preferably molded with contact holes formed therein, whereby the pins 14 can be snapped into the holes as is known in the art. Although the connector 10 is shown and described to have pins 14, it is to be understood that the contact body 12 may have sockets 40 wherein the external connector 42 would have pins.

A second connector 44 can be connected to the opposite end of the printed circuit board 26. The second connector 44 is preferably attached to the circuit board 26, before the connector 10 is mounted onto the board 26. As an alternate embodiment, the second connector 44 can be integrally molded with the connector 10. The second connector 44 typically has sockets 46 embedded into a housing 48. The sockets 46 have tails that are soldered onto the board as described above. The second connector 44 plugs into another connector (not shown) that has mating pins. The other connector is typically attached to the motherboard of a computer system. The edge sections may each have molded in channels 50. The channels 50 may combine with a locating edge or pin within the computer, to guide in the board and align the second connector 44 with the motherboard connector.

A pair of covers 52 can be attached to the connector 10 to enclose the printed circuit board 26. As shown in FIG. 2, the connector 10 may have a pair of second ridges 54 that support the covers 52. The second ridges are constructed so that the covers 52 are flush the top of the connector 10, to create a very thin electronic card. Each side of the covers 52 may have a pair of tabs 56 that fit within slots 58 in the edge sections, to provide an easy means of attaching the covers 52. The covers 52 are preferably constructed from sheet metal to provide additional structural support for the connector 10 and protection of the electronic devices 30 from electromagnetic interference (EMI).

The connector 10 has a narrow profile, so that the assembled card can be inserted through a narrow opening in a portable computer, to allow the board to be coupled to the system. The board may provide a communication I/0 function such as a modem or facsimile, wherein the computer can be connected to communications means by plugging the external connector 42 into the connector 10.

While certain exemplary embodiments have been described in detail and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An electronic card assembly, comprising;

a printed circuit board having a first end, a second end and a pair of edges between said ends, said printed circuit board having a first surface and a second surface;

a frame having a first end section adjacent to said first end of said printed circuit board and a pair of edge sections extending from said first end section and adjacent to said edges of said printed circuit board, said frame further having an integral first electrical connector within said first end section, said first electrical connector being coupled to said printed circuit board;

a second electrical connector attached to said second end of said printed circuit board;

a first cover detachably connected to said frame to enclose said first surface of said printed circuit board; and, a second cover detachably connected to said frame to enclose said second surface of said printed circuit board.

2. The electronic card assembly as recited in claim 1, wherein said first and second covers each have hooks that can be received by slots within said edge sections of said frame, such that said covers can be attached to and removed from said frame.

3. The electronic card assembly as recited in claim 2, wherein said frame has a pair of beams attached to said edge sections and extending across said printed circuit board.

4. The electronic card assembly as recited in claim 3, wherein said edge sections each have a channel adjacent to said second end of said printed circuit board.

5. The electronic card assembly as recited in claim 4, wherein said second electrical connector is integrally molded with said frame.

* * * * *